US006277041B1

(12) United States Patent
Fenn

(10) Patent No.: US 6,277,041 B1
(45) Date of Patent: Aug. 21, 2001

(54) DART HAVING RESILIENTLY MOUNTED POINT AND FLIGHT SHAFT, AND USER-MODIFIABLE BODY AND WEIGHTING FEATURES

(76) Inventor: George E. Fenn, c/o D. R. Caprio, Pro-West Machine Shop 9850 Kitty La., Oakland, CA (US) 94603

( * ) Notice: Subject to any disclaimer, the term of this patent is extended or adjusted under 35 U.S.C. 154(b) by 0 days.

(21) Appl. No.: 09/305,338

(22) Filed: Jan. 20, 1999

Related U.S. Application Data

(63) Continuation-in-part of application No. 08/560,546, filed on Nov. 17, 1995, now abandoned.

(51) Int. Cl.[7] ..... A63B 65/02
(52) U.S. Cl. ..... 473/578; 473/582; 473/586
(58) Field of Search ..... 473/578, 582, 473/585, 586, FOR 216, FOR 219, FOR 220, FOR 223

(56) References Cited

U.S. PATENT DOCUMENTS

| | | | | |
|---|---|---|---|---|
| 3,957,271 | * | 5/1976 | Kurtz et al. | 473/586 |
| 4,101,126 | * | 7/1978 | Kurtz et al. | 473/582 X |
| 4,858,927 | * | 8/1989 | Simmons | 473/586 |
| 5,009,433 | * | 4/1991 | Reid | 473/582 |
| 5,118,117 | * | 6/1992 | Denen | 473/585 |
| 5,271,625 | * | 12/1993 | Kurtz et al. | 476/585 |
| 5,505,460 | * | 4/1996 | Wolfenden et al. | 473/585 |
| 5,642,887 | * | 7/1997 | Orav | 473/586 |

FOREIGN PATENT DOCUMENTS

| | | | | |
|---|---|---|---|---|
| 419323 | * | 11/1934 | (GB) | 473/FOR 220 |
| 589629 | * | 6/1947 | (GB) | 473/FOR 216 |
| 599242 | * | 3/1948 | (GB) | 473/FOR 220 |
| 1509198 | * | 5/1978 | (GB) . | |
| 2026878 | * | 2/1980 | (GB) | 473/FOR 219 |
| 1590954 | * | 6/1981 | (GB) | 473/FOR 216 |
| 2153693 | * | 8/1985 | (GB) . | |

* cited by examiner

*Primary Examiner*—John A. Ricci

(57) ABSTRACT

A dart is disclosed which includes a flexibly mounted point and flight shaft. The dart includes a central tubular body which has fore and aft end caps. The fore cap includes a central bore, a forward through bore, and a socket therebetween. A point is mounted in a carrier, which is received in the central bore of the fore cap and seats in the socket. An elastomeric spring cylinder biases the carrier forward so the point is normally located along the dart axis. Upon impact with a target, the point can move longitudinally and, in some embodiments, pivot under compression against the spring cylinder, to reduce the chance of dart rejection if it strikes a target impediment or divider. The rear flight shaft can be mounted in a manner similar to the point, so the dart flights have reduced tendency to deflect other incoming darts. The central body includes an adjustable weighting arrangement. The parts of the dart may be provided in a kit form to allow a player to adjust the dart weight, balance, and characteristics to his preference.

12 Claims, 7 Drawing Sheets

FIG. 4
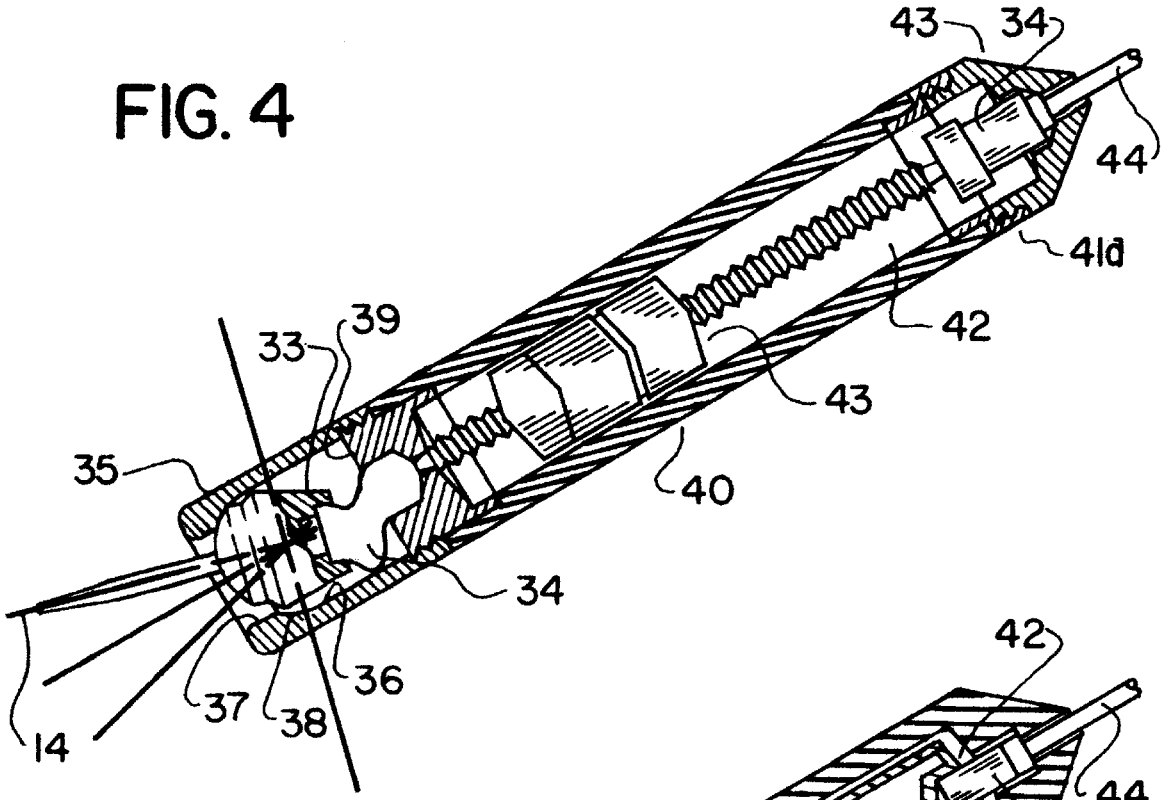
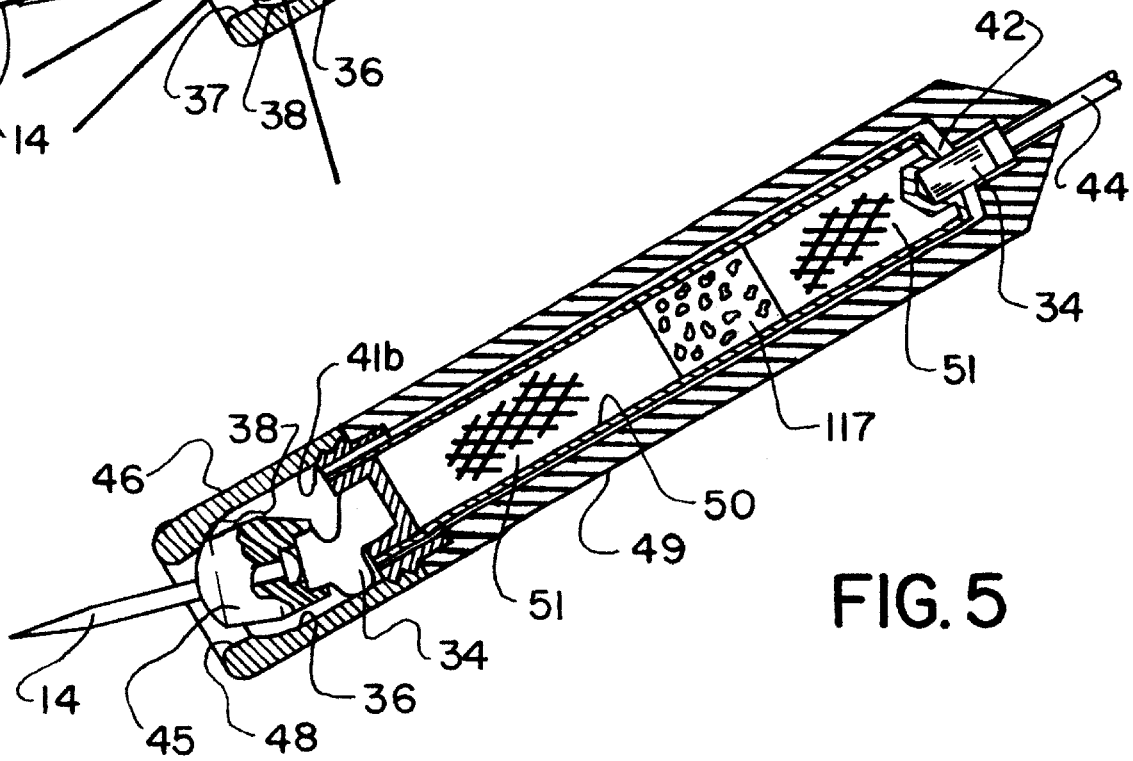
FIG. 5

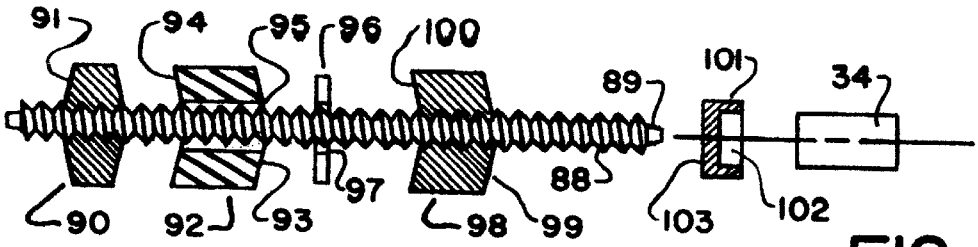
FIG. 9
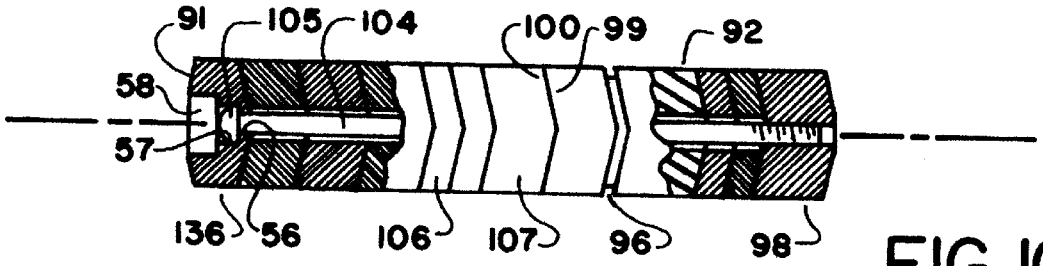
FIG. 10
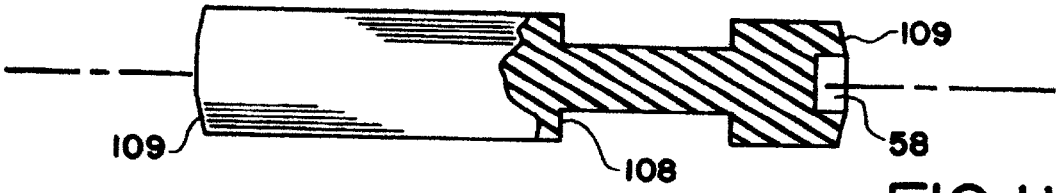
FIG. 11
FIG. 12
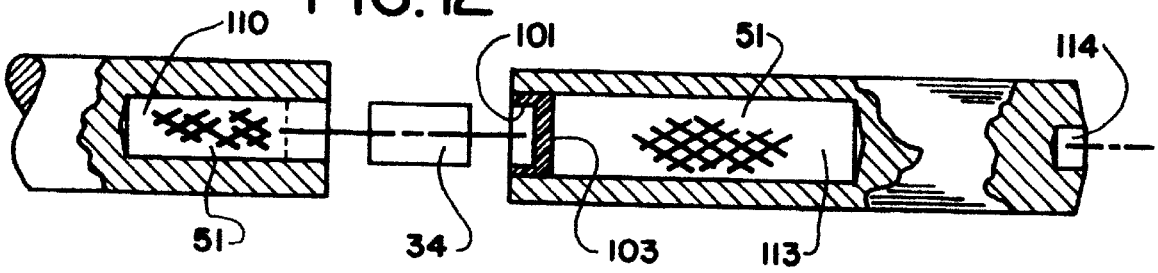
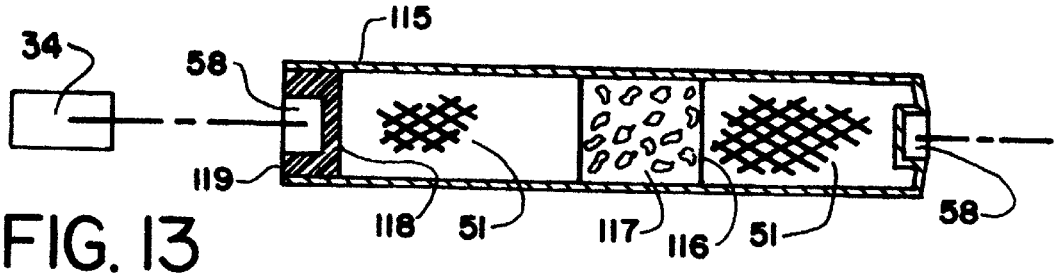
FIG. 13

DART HAVING RESILIENTLY MOUNTED POINT AND FLIGHT SHAFT, AND USER-MODIFIABLE BODY AND WEIGHTING FEATURES

CROSS REFERENCE TO RELATED APPLICATION

This application is a Continuation-in-Part of application Ser. No. 08/560,546, filed Nov. 17, 1995, now abandoned.

DISCUSSION OF THE PRIOR ART

There have been an extremely large variety of advances made in and for the various games of darts. A dart is a hand held tubular projectile having a point, that is generally designed to be thrown at a target for the purposes of scoring within circularly and radially defined impact areas on the target. A typical dart also includes an attachable shaft carrier aft of and axially oriented to the main body which generally carries guidance vanes, called flights, to help stabilize the trajectory of the thrown dart.

In most cases, the advances have been applied to an external shape of the dart. Various materials are used to create the barrel or central segment of a dart body, such as wood, brass, various amalgams, or tungsten. Into these materials are formed various shapes or patterns, designed to enhance the user's grip or finger placement. Shapes may include dish-outs for finger placement, or knurling.

Points for darts may be either "soft tip" or "steel tip". The soft tip is usually of plastic, and designed to be used with an electronic scoring board. The steel tip is a hardened metallic member designed to impact a target of densely packed sissal which can accept the scoring point, so the player can visually establish the value of the thrown dart. A steel tip dart must remain in the target during the player's turn sequence (which may include throw of multiple darts), to create a score. Both the electronic and sissal target boards include areas of different value separated by thin metal or plastic dividers (sometimes called "spiders"). If a dart directly impacts a divider, it may bounce off the target without sticking or scoring. Prior attempts have been made to design darts which will remain in the target even if a divider is struck.

In one approach, the soft tip has been formed from a composite of carbon oriented plastic so as to provide a means of flexion when it strikes the target, thereby reducing the chance of rejection by a divider. In this composite dart tip, it has been shown that if the dart tip is sharpened after deformation created by impact with an impediment, the harmonic signature of the dart is changed.

Another prior art dart point approach, has been to provide means to allow for axial movement of the point within a forward containment area of the central dart body, with various controls therefor. Several approaches employ a floating point shaft contained in or by a screw-in race, one being a manually applied pinch effect of the taper of the point in an axial bore of the race, where, impact with the target releases the point so as to allow a hammer effect to drive the dart further into the target. Another approach involves an enlarged aftward head on the axial point shaft, either being rounded or drop hammer formed in a manner called peening, with the head being constrained by a screw-in or press fitted race, or obverse axially oriented machining; and, constrained forwardly by manually induced placement, or by annularly placed resilient washers, or O rings. Other approaches, rather than O-rings, have utilized axial placement of resilient strips in machined grooves to engage the shaft's collar in an attempt to slow the impact moment; whereas, a variation to the O-rings employs radially inwardly projecting fingers that interact with the enlarged collar to control the impact induced moment in the containment cavity. Again, these various structures are employed in a hammering system; but, there is a failure to recognize that this approach, during initial impact with a target or divider, does not allow the linear alignment between the dart's point and body to be altered.

Further, in several of the latter approaches, the O-rings have been placed in a subtending annular race of the enlarged shaft ending head; or, they have been placed in the orienting insert, within a radially outwardly positioned annular raceway; or, they have been placed, in combination, forwardly of that enlarged head and in the raceway. But, in these darts, it is common to find that substantial wear occurs, as the rotation of the variously placed O-rings are working against a stationary shoulder, thereby limiting the value of the point movement.

Another approach has been the usage of a spring body surmounted about a shaft positioner so as to provide an axially oriented progressive loading characteristic for impact with a scoring area. However, springs are known to lose temper due to the short compression cycle experienced by the impact of these darts.

In other darts, the aftward portion of the shaft-ending enlarged head can impact a taper formed in a cavity-ending buttress, this to provide an angular distortion about the body or barrel's axis; a conoid machined shaft that impacts a similarly shaped and obversely positioned conoid body thereaft during impact-induced axial travel, this to provide a non-axial motion when impact with the target's dividers or impediments occurs, particularly in the segments that have the highest scoring value. But, it is known that the use of springs, with their subsequent loss of temper caused by pico-second impact can and do lose this non-axial movement utility; both coil springs and metal strips which are constrained against lateral displacement outside the axis of the load causes direct loss of that ability.

Also, due to the various construction methods, none of these approaches have the ability to ignore the effects of gravity, which may eliminate their effectiveness, because, when the point is retained in the target board, the body of the dart may be angled downwardly relative to the point, and this body may block subsequent darts thrown toward small areas of high score value.

One such example is the internal and forward use of a resilient cylinder with an axially formed bore receiver for receipt of a point shaft, with the aftward end thereof being rounded, with the resilient body simply push-inserted into a receiver cavity of the dart, and placement being arrested by the round end of the shaft against a buttress. There are no provisions against the elastomeric cylinder's propensity to return to an unloaded state; distortion created by non-axial movement upon impact with a target would cause the cylinder to actually creep out of this position; this distortion would tear the bore therein.

Two other approaches employ either a wound spring on the depending shaft of the point, or to a flight-carrying shaft; while showing some utility, neither recognizes that heat and/or non-axial loading will cause displacement or breakage of the point. The wound spring, like its rubberoid counterpart, will actually displace itself from the containment cavity upon lateral displacement. The cupped spring with curved end catchments for the flight shaft, or any half-dome with a central hole receiver for that shaft carrier, faces two considerations: any spring, beyond heat loss, will attempt to return to an unloaded state, thereby becoming an impediment that could interfere with the trajectory of subsequent darts; whereas, the fully cupped spring, beyond the increased potential of resistance, actually embodies a buckle effect. In addition, a strip-type spring, like those above, limits the flight-carrying shaft to only two directions of movement, they being along the axis formed by the width thereof.

Regarding the weights and shapes of darts available, there have been more than one approach. One is an end-threaded shaft that connects the fore and aft ends of the barrel. Various axially-bored pieces of varying density are placed along the shaft to create varying weight and shapes. Stability is improved by an O-ring positioned appropriately.

Another employs a similar internal shaft, and has a variety of weight beads that are placed thereon by the user, prior to insertion into an internal cavity of the barrel, where stability is derived, again, by an appropriately positioned O-ring.

Yet another employs various media, in the hammer approach, that are sometimes separated so as to provide a differing method of weight distribution within the internal chamber of the dart.

Then another employs a simple and fixed addition to the internal chamber, from the aft end, the density of which changes relative to the desired weight; but, whose forwardly positioned end in the tapered receiving bore is employed as a buttress, it affecting the point's reaction to impact of impediments.

Additionally, another approach combines the annular receipt of an O-ring impinging a ball-ended shaft, with that ball impinging upon the forward end created by impact.

In all of the above approaches, while showing some utility, none consider the effect of having a forwardly formed cavity which affects the desired forwardly induced weight differential. Additionally, because of the possibility of loosening, which can cause rattling and distraction; or the fact that the loss of any one piece can eliminate that dart from play, the utility of the prior art are considered minimal at best.

And, regarding guidance vanes or flights, there have been a variety of attachment variations: there is a polymer shaft, extending radially aftwardly from the central body, generally being threadably attached, and having forward molded receiver slots in an X-format, it receiving a press-insertion of the flights chosen by the player; or, obversely joined V's, the vertice junction creating a slot for that flight member insertion. And, there have been specialized flight-carrying shafts that receive a tripodal vane rather than the four vanes more commonly used for the guidance of the thrown projectile, this approach limiting the impediments involved in trajectory interference.

Another approach, called SLIKSTIK, employs that shaft but has a slot that is end-bounded that, in turn, receives the "X" flight slipped laterally into and positioned at the aftward end of the slot prior to the player's throw, this allowing forward but non-radial movement created from impact with any subsequently thrown dart. And, after the throw and removal from a target, must be manually moved to the backward station.

One of the first spinning flights, called DYNA-STAR, employs an aftwardly axial shaft that has an enlarged portion thereon for receipt of a pull-molded spline carrying the flights, that is slip-pressed onto and beyond a pinch created shoulder of that shaft carrier. This allows radial movement created by an incoming projectile thrown in close proximity to an at-rest dart.

There are others that are also rotational about the dart axis; but, none recognize that by the time the impact induces any spinning movement, the dart is well past the point of collision therewith. In addition, spinning about that axis can be a detriment; none take into account that the darts thrown have multiple speeds and trajectories.

In all of the prior art approaches noted, notwithstanding the displayed utility, the attempts have been to provide the player with a dart that will enhance their application of skills and growth in the game of darts. Yet, there are possible advances to the general application of dart design that will enable the particular user to create a more fully personalized involvement with this enjoyable game, thereby furthering the art of the game and the player's approach towards serious enhancement of their skills.

SUMMARY OF THE INVENTION

The invention employs various embodiments of soft tip and steel tip darts. The darts can be personalized while maintaining the same overall external shape. The darts are designed to greatly reduce or eliminate rejection if the dart hits a divider or other impediment, as well as to have reduced interference with and deflection of subsequently thrown darts to target areas of high value.

This toy projectile is designed to be thrown at a polymer surface having a plethora of holes, in the electronic game; or at a sissal target for receiving the steel tip, in the traditional game. Both types of target usually have scoring areas delineated by radial and circumferential spokes (or "spiders"). An important design consideration for the soft tip dart is that the dart must depress a scoring segment, even if initial contact is with a spider; whereas, steel tip darts require that a thrown dart must remain in the board until removed by the player to score, as any dart that falls out during the turn does not count towards a score in that turn.

A carrier was created that holds a point having a shaft and enlarged shoulder. This carrier, in three disclosed embodiments, employs a forward partial ball, for example of DELRIN®, and fore and aft subtending tapers; or a TEFLON® (PTFE) insert giving axial constraint. Each embodiment of the carrier receives the shaft and shoulder through a bore and countersink cup from the aftward position.

The carrier mates with a forecap at the forward end of the dart. Two embodiments of forecap are disclosed. In one embodiment, the forecap includes an aft bore, and a smaller diameter forward bore, with a socket therebetween, the sides of the forward bore being tapered. In another embodiment, both through bores have parallel walls.

Unlike the prior art springs which control point movement upon impact, my invention uses an elastomeric or rubberoid cylinder, for example of extruded silicone derivative. The cylinder is received in a cupped receiver of the point carrier. The hardness of the cylinder can range from 40 to 70 SHORE A.

Another aspect of the invention is the adjustability of the internal weighting, while maintaining the same outer shape. Behind the forward point and carrier, is a weight receiving chamber. Several types of weight arrangements may be inserted in this chamber.

In one embodiment, a fully threaded stick is provided, along with at least one weight bead, for example tungsten, having an axial bore to receive the stick therein. Threaded nuts are placed on the stick on each side of the bead, and tightened against the bead to adjustably hold the weight bead(s) in the desired position. A rubber washer may be placed between the bead and nut for additional stability.

The nut(s) and bead(s) have complementary shapes for a close fit, such as a chevron shape.

In a variation of this weight stick embodiment, the shaft is provided with an enlarged shoulder at one end, and a short threaded segment at the other end. At the shoulder end is an end piece having a cup receiver for receiving the elastomeric cylinder. Threaded onto the threaded end is a stop washer. Between the end piece and nut, various weights are placed in a desired configuration along the shaft.

In another embodiment, a solid weight body is provided, of complementary shape to the weight chamber. The weight body, for example tungsten, may have an annular cutout portion to adjust the weight.

In another embodiment, the weight body is a solid aluminum billet, with a bore in one end. Weight powder, such as tungsten, is packed into the bore. The bore is closed off by a cup member, which receives the elastomeric cylinder.

Another embodiment of the weight body is an aluminum tube. Into the tube is packed weight powder, such as tungsten. A rubber filler piece may also be placed in the tube between layers of tungsten powder, to adjust the weight distribution. The tube is capped off with a cupped receiver which can receive the elastomeric cylinder.

It is important to note that in each weight embodiment, the weight along the dart body does not have to be uniform, but can be adjusted so the fore and aft sections of the dart have a desired weight ratio. It is contemplated that the fore/aft weight ratio will be adjustable between 50:50 and 95:5.

Another important aspect of the invention is the rear flight carrier. The flights of a dart which is received in a target may deflect the path of a subsequently thrown dart. The invention includes several embodiments designed to reduce this deflection.

The attachment of the flight carrier to the dart body may be similar to the attachment of the point to the dart body. In one embodiment, the flight shaft has an enlarged collar at its forward end, the shaft extending rearward and adapted to receive conventional flights. Like the point, movement of the flight shaft may be controlled by an elastomeric cylinder, located aft of the weight chamber and forward of the shaft collar.

The flight shaft may be received in a carrier which allows non axial movement. The carrier includes a bore to receive the shaft, and a forward countersink to receive the collar. The carrier includes a cupped forward portion to receive the elastomeric cylinder. The carrier is held in place by a rear end cap which may have tapered sides.

Instead of having two endcaps, the central body of the dart may be machined so one end cap is integral therewith.

It is contemplated that the invention will be especially useful when sold in a kit format: the kit would include dart bodies and internal weights of various types and values that the player could arrange to best suit his needs for a desired game. The player could gain access to the dart interior by removing one end cap, and then adjust the weight assembly therein, and reattach the end cap.

BRIEF DESCRIPTION OF THE DRAWINGS

FIG. 4 shows a longitudinal cross section of one embodiment of a soft tip dart of the present invention.

FIG. 5 shows a longitudinal cross section of one embodiment of a steel tip dart of the present invention.

FIG. 9 shows a longitudinal cross section of a threaded weight stick with weight components installed thereon.

FIG. 10 shows a longitudinal view, partly in section, of a partially threaded weight stick with weight components installed thereon.

FIG. 11 shows a longitudinal view, partly in section, of a solid weight billet.

FIG. 12 shows a longitudinal view, partly in section, of two possible embodiments of a weight billet with a bore therein to receive weight powder, showing receipt of an elastomeric cylinder.

FIG. 13 shows a longitudinal view, partly in section, of a hollow weight carrier with an end cup to receive the elastomeric cylinder.

DETAILED DESCRIPTION OF THE INVENTION

Figure 1:
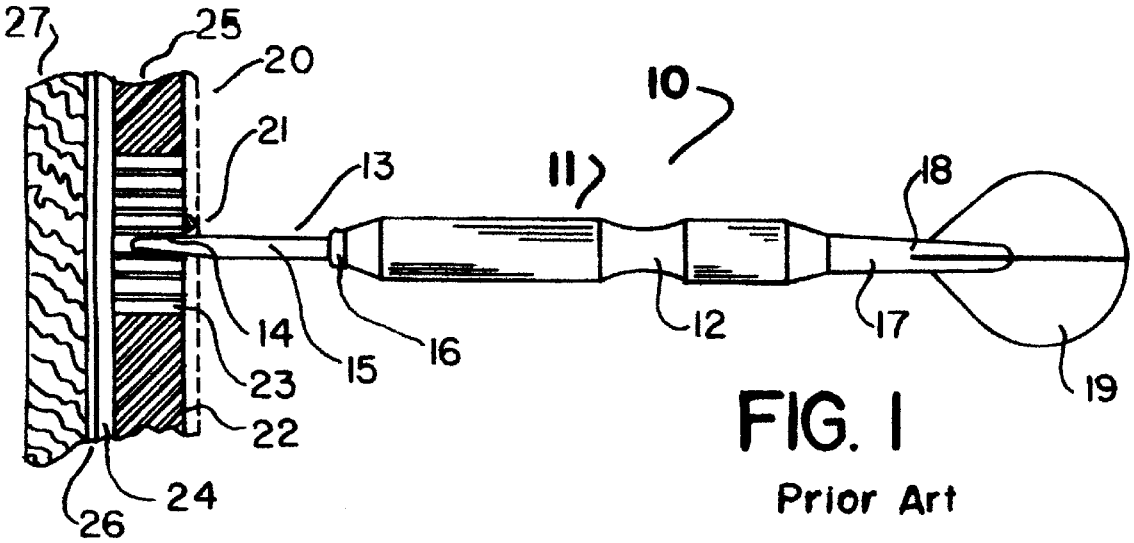
FIG. 1 Prior Art
FIG. 1 shows a prior art soft tip dart received in an electronic scoreboard.

Referring to FIG. 1, this shows a typical dart 10, with a soft tip, comprising tubular central body or barrel 11 having grip 12; screw-in scoring tip 13 with a tapered front 14 and larger shaft 15, and screw-in collar 16 threadably joined to the barrel. At the rear of the dart is a screw-in flight-carrying shaft 17, with an X-slot 18 for receiving slide-in flight 19.

The typical electronic dart board 20 includes a scoring face 22, with areas of different value delineated by boundaries or "spiders" 21. The scoring face includes holes 23 for receiving the dart tip. Impact planes 24 and 25 cooperate with signal plane 26 to record the score. The board is mounted on backing carrier 27.

Figure 2:
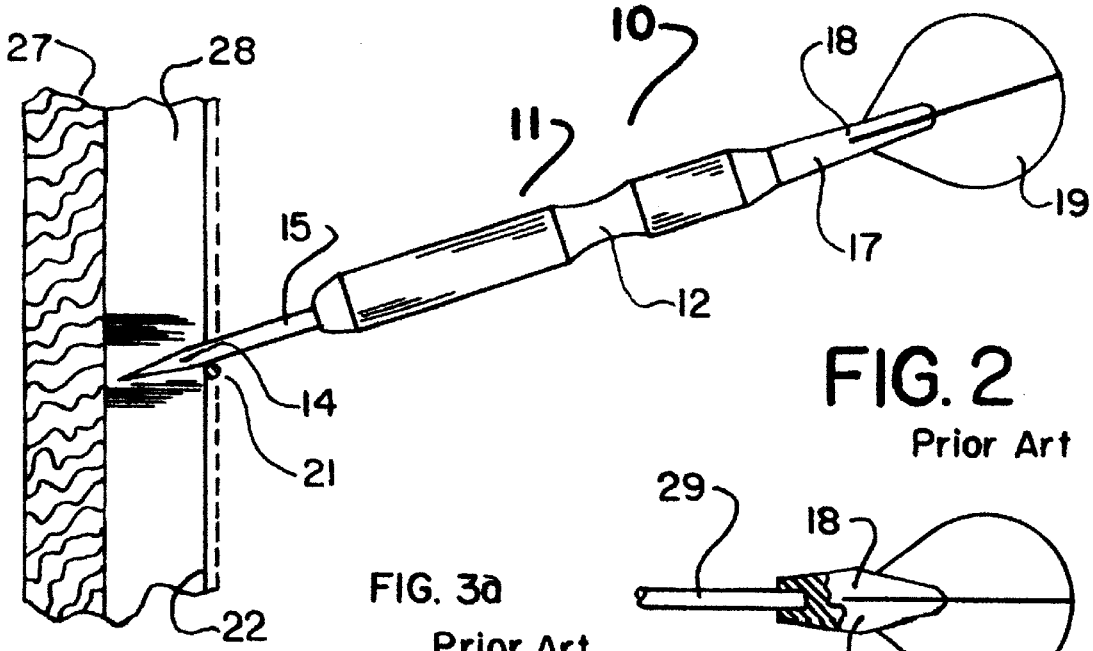
FIG. 2 Prior Art
FIG. 2 shows a prior art steel tip dart received in a sissal scoreboard.

FIG. 2 shows a typical steel tip dart received in a typical sissal board 28.

Figure 3A:
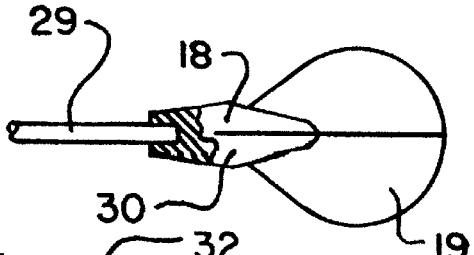
FIG. 3a Prior Art
FIGS. 3*a* and 3*b* show prior art arrangements for attaching dart flights to a shaft.
Figure 3B:
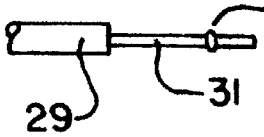
FIG. 3b Prior Art

FIG. 3*a* shows a flight carrying shaft used in the prior art, comprising round rod 29 for receiving press fitted carrier 30 having an X-slot 18 to receive flight 19. FIG. 3*b* shows that rod 29 may have a wire 31 extending therefrom, the wire having an indent 32 for receiving DYNASTAR flights.

FIG. 4 shows a cross section of one possible dart of this invention, having a soft tip 59. The dart includes a central body 40, a threaded forecap 35 attached to the central body, and a threaded rear cap 43 attached to the central body. A threaded insert 39 is threaded into the central body and contains a forward threaded section to which the forecap 35 is attached, as well as a forward indentation or cup 73. The forecap includes a large central through-bore 36, and a reduced diameter front through-bore 37 with a socket 38 for receiving a carrier 33. The carrier 33 is for supporting a scoring point 14, which extends through bore 37 for contacting a target board. A central bore 56 extends through the carrier for receiving point shaft 60. The rear of the bore 56 opens to a seat 57 for receiving point collar 61. The rear of seat 57 opens to an indentation or cup 58. An elastomeric cylinder 34 is received in and held between the cup 58 of the carrier and cup 73 of the threaded insert. As shown, the carrier 33 includes a forward convex, partial ball 52 received in socket 38. The carrier is tapered as shown by angle 53 to help it seat in the socket under compression from cylinder 34. A shoulder 54 is provided as a seat against socket 38. Absent any impact forces, the cylinder 34 will tend to bias the carrier to a central position so that point 14 is aligned with the longitudinal axis of the barrel. As the point impacts against a target, the carrier is able to pivot in an arc 62 relative to the forecap against a restoring force provided by spring cylinder 34, so the point 14 can assume an orientation not along the longitudinal axis of the dart barrel. Pivoting is limited by rear taper 55.

Located within the central body 40 between threaded front insert 39 and threaded rear insert 41*a* is a chamber 42 for receiving a weight assembly. As shown in FIG. 4, the weight assembly may include a threaded rod 88 with pintle ends 89. The pintle ends of the threaded rod are held between bores 77 of inserts 39, 41*a*.

Between the rear insert 41*a* and the end cap 43 is a chamber. The rear cap 43 may include a bore 84 facing forward. The rear insert 41*a* may include a cup protector 101 having a cup 102 facing to the rear. The rear cap further includes a central bore 86 of reduced diameter compared to the bore 84 and communicating with the bore 84 at a shoulder 85. A flight shaft 44 with collar 124 is received in the cup and retained by the shoulder 85. A rear elastomeric cylinder 34 is received between cup 102 and bore 84, and biases the shaft 44 toward the rear.

FIG. 5 shows a another possible embodiment of a dart, with a modified carrier 45 and modified forecap 46. In forecap 46, the front bore has inclined sides as shown by angle 48; carrier 53 has a tapered front section shown by 53. No shoulder 54 is necessary since the tapered sections 48, 53 will mate to keep the carrier centered. The dart of FIG. 5 also includes an internal weight body 50, which receives tungsten powder 51 and elastomeric material 117, located within weight chamber 42. The weight chamber includes forward and rearward integral cups 58 to receive front and rear elastomeric cylinders 34. Also note that structure equivalent to a rear cap 122 is integral with central body 49.

Figure 6:
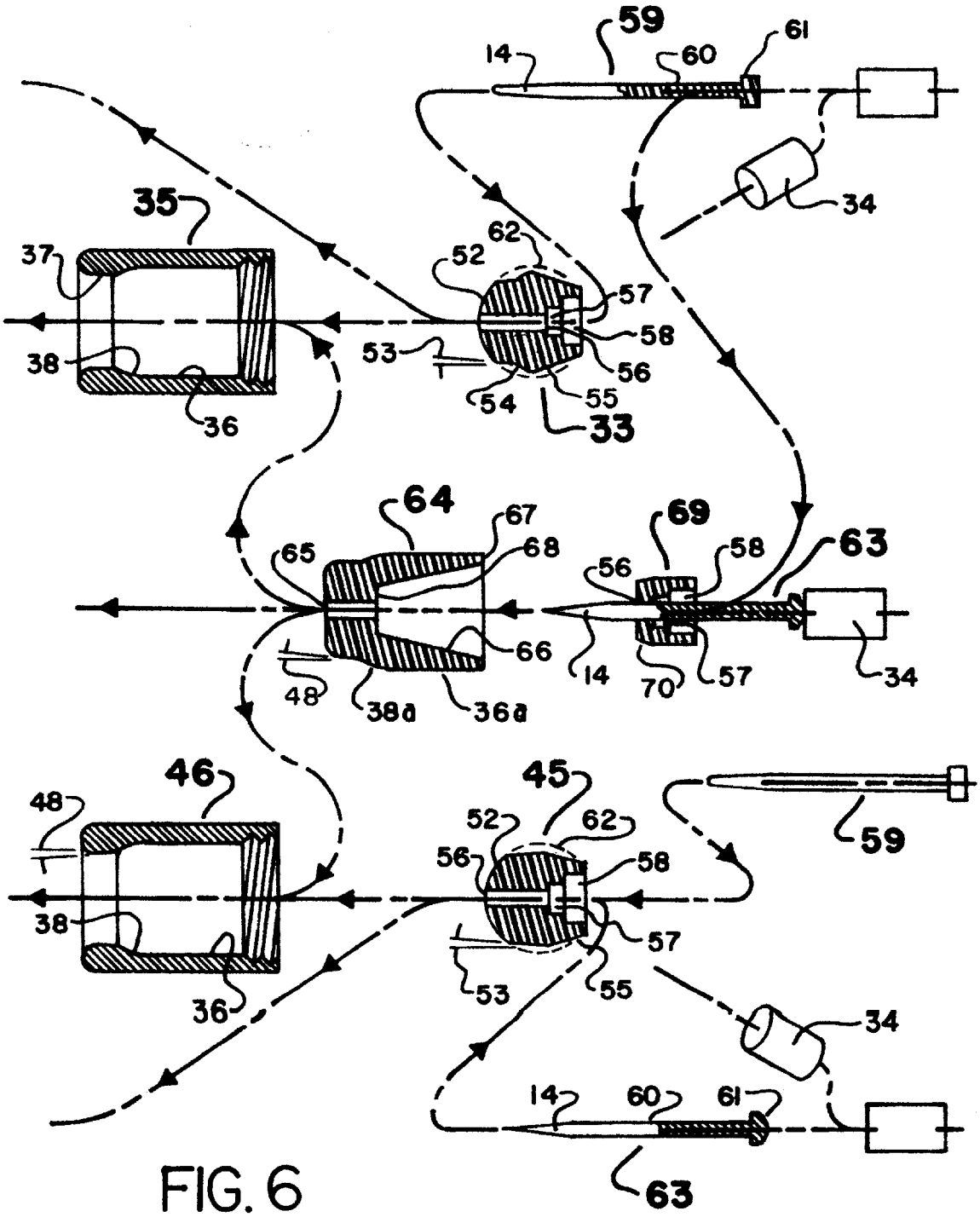
FIG. 6 shows an exploded cross section of various possible combinations of forecap, point carrier, point, and elastomeric cylinder.

FIG. 6 shows various possible combinations of parts that may be assembled to form the front end of the dart. For example, it is seen that a soft tip 59 can be received in a "weak" carrier 33, which is received in a threaded forecap 35 (as shown in the example of FIG. 4). A soft tip 59 or a steel tip 63 can be received in a "strong" carrier 45, which is received in a threaded forecap 46. Also shown is a non pivotal carrier 64. This carrier can be used with either forecap 35 or 46, in cases where it is desired that point 59 or 63 be longitudinally movable under bias from cylinder 34, but not pivotal. Non-pivotal carrier 64, which may be made of TEFLON® (PTFE), includes a central bore 65 to receive the point, a shoulder 38*a* to seat in socket 38 of the forecap, side walls 36*a* to engage forecap bore 36 and prevent pivoting, a rearwardly facing open cavity having tapered walls 66 and an inner abutment 68, and rear shoulder 67 to engage a forward wall 74 of a threaded insert. The point 59 or 63 is received in a bore 56 of a shoe 69, having a tapered side wall 70 to engage the tapered wall of carrier 64. The rear of the shoe includes bores 57 and 58 to engage the point collar 61 and cylinder 34 respectively.

Figure 7:
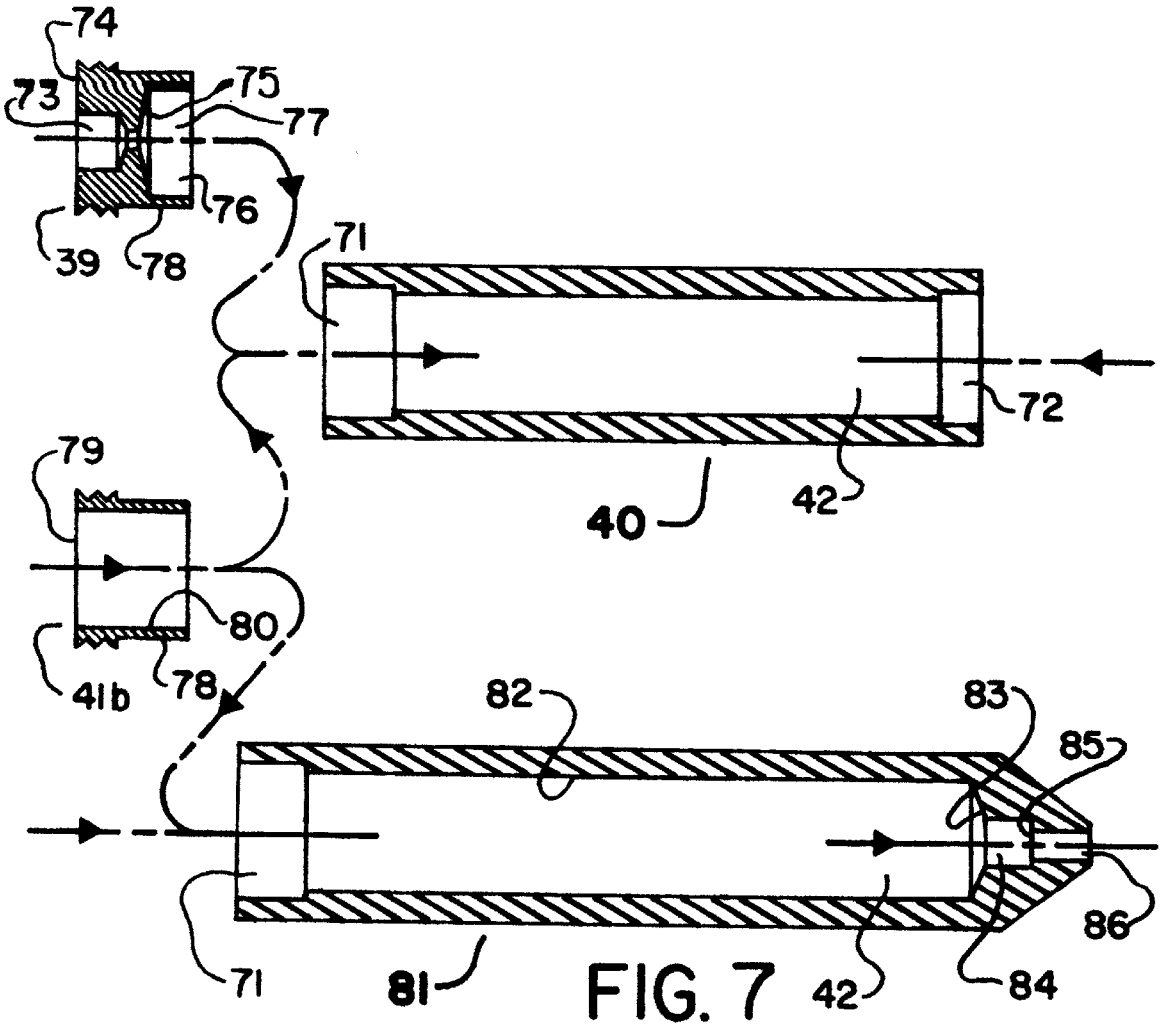
FIG. 7 shows an exploded cross section of various possible combinations of a central dart body, and removable end cap.

FIG. 7 shows two possible embodiments of the central dart barrel or body 40, 81, as well as two possible thread bearers 39, 41*b* that may be attached thereto. The barrel 40, which may be of tungsten, includes a central through bore 42, and larger diameter end bores 71 and 72. Bore 42 is intended to receive a weight assembly. End bore 71 is intended to receive a forward thread bearer 39 or 41*b*. As shown, thread bearer 39 or 41*b* includes a rear cylindrical wall 78 which is engageable in bore 71. Thread bearer 39 includes an end chamber 76 and end wall 75, through which bore 77 extends to receive the pintle end of a weight stick. Thread bearer 41*b* includes a through bore 80, which can receive the end of a weight body 50.

FIG. 7 also shows an alternative dart body 81, in combination with thread bearer 41*b*. The dart body 81 includes a central bore 82 intended to receive a weight assembly. One end includes an integral cap, having end buttress wall 83. Extending into wall 83 is bore 84, for receipt of cylinder 34. The inner end of bore 84 having shoulder 85 to seat collar 124 of a flight shaft; bore 86 extends from the shoulder to the exterior to slidably receive flight shaft 44.

Figure 8:
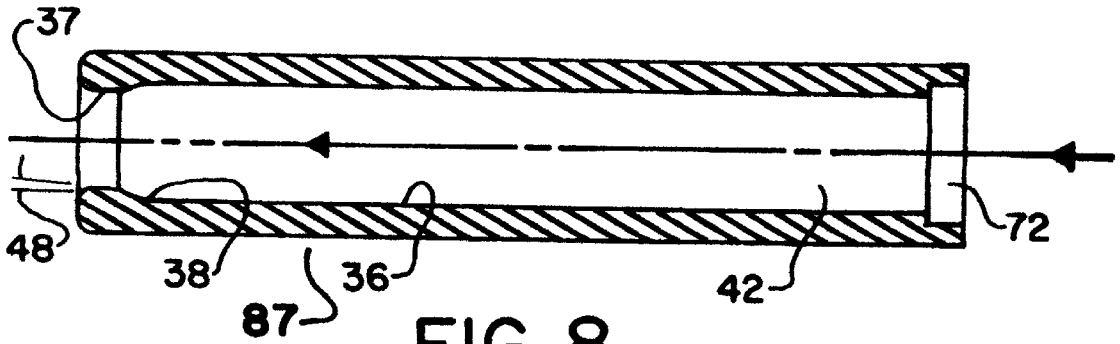
FIG. 8 shows a longitudinal cross section of another embodiment of a central dart body, having a partial socket formed integrally therewith.

FIG. 8 shows an alternative dart body 87, in which structure equivalent to forecap 35 or 46, is integral with the body. The fore end includes a socket 38 formed into the body. Forward bore 37 may have tapered sides 48.

FIG. 9 shows one embodiment of a weight assembly for placement within the dart. A rod 88, for example stainless steel, is fully threaded, except for pintle ends 89. A weight bead 92, for example tungsten, having a central bore 95, is received over the rod and manually placed at a position desired by the player to achieve a desired weight distribution. A position nut 90, and a stop nut 98, each having a threaded central bore, are then threaded onto the rod, on either side of the weight bead, and tightened to hold the bead in the desired position. An elastomeric washer 96 having a central hole 97, may be placed between the bead and nut for better alignment. The nuts and bead may include complementary walls 91, 93, 94, 99, 100 of chevron shape for a more close fit. Also note that the shape of wall 91 of nut 90 is complementary to wall 75 of thread bearer 39, and wall 99 of nut 98 is complementary to forecap wall 83.

FIG. 10 shows an alternative weight assembly. This weight assembly includes a central shaft 104. One end of the shaft has an enlarged head 105; the other end of the shaft is threaded for a short distance, sufficient to receive end stop nut 98. End nut 136 includes an end wall 91, a bore 58 to receive cylinder 34, a smaller bore 57 to capture head 105, and a through bore 56 for passage of shaft 104. Located along the shaft between end nuts 136 and 98, may be placed pieces 106, 107 of selected weight characteristics, as well as a tungsten bead 92, and washer 96. A player can customize the weight distribution of the dart by removing end nut 98, and placing pieces 92, 106, 107 of desired weights along the shaft in desired locations, and replacing nut 98 to hold the assembly together. Note that pieces along the shaft may have complementary chevron shaped walls.

FIG. 11 shows an alternative weight body. This is a billet of solid material such as tungsten. Machined thereinto are end shoulders 109 of shape complementary to wall 75 of thread bearer 39, and wall 83 of aft cap 43. At one end, a cup for cylinder 34 is machined into the billet. The billet also includes a cutout or race section 108. This cutout may be offset relative to the center of the billet, to create a desired fore/aft weight distribution, ranging from 50/50, to 95/5.

FIG. 12 shows segments of two alternative weight bodies. The weight body shown on the left is a billet of material, preferably T-6 aluminum. Extending into one end of the billet, to a desired depth, is an axial cavity 110. Into the cavity is packed a quantity of powdered metal, preferably tungsten powder 51, leaving a gap delimited by level 112, the gap serving as a cup for receiving elastomeric cylinder 34.

FIG. 12 also shows, to the right, an alternative weight body. Like the weight body shown to the left, this weight body is a billet of material, preferably T-6 aluminum. Extending into one end of the billet, to a desired depth, is an axial cavity 113, of larger diameter than bore 110. Into the cavity is packed a quantity of powdered metal, preferably tungsten powder 51, leaving a gap which can receive cup bearer 101. Cup bearer 101 includes an inner wall 103 which serves to retain the metal powder in the bore, and a cup 102 for receiving elastomeric cylinder 34. The opposite end of the billet includes an end wall 109, with a cup 114 for receiving an elastomeric cylinder 34. Note that cup 114 is of smaller diameter than cup 102, for receiving a smaller diameter cylinder 34 (note FIG. 5).

FIG. 13 shows an alternative weight assembly. The assembly has a carrier 115, preferably of spun cast aluminum. A cup receiver 58 is molded into one end. A first charge of metal powder, preferably tungsten powder 51, is packed into the carrier to a first position 116. An elastomeric member 117 is then pushed into the carrier to retain the first charge in place. A second charge of powder 51 is then packed into the cylinder to a second position 118. A closure body 119 is then pushed into the carrier to retain the second charge in place, the closure body having a cup receiver 58 for cylinder 34. By adjusting the relative amounts of powder in the first and second charges, one can adjust the relative fore and aft weight ratio of this weight assembly.

Figure 14:
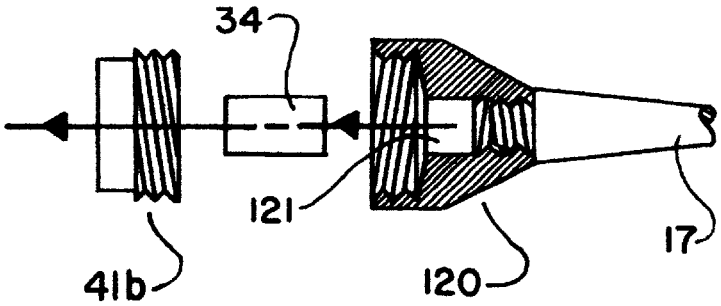
FIG. 14 shows an exploded cross section of an attachment of an end cap to the dart body.
Figure 15:
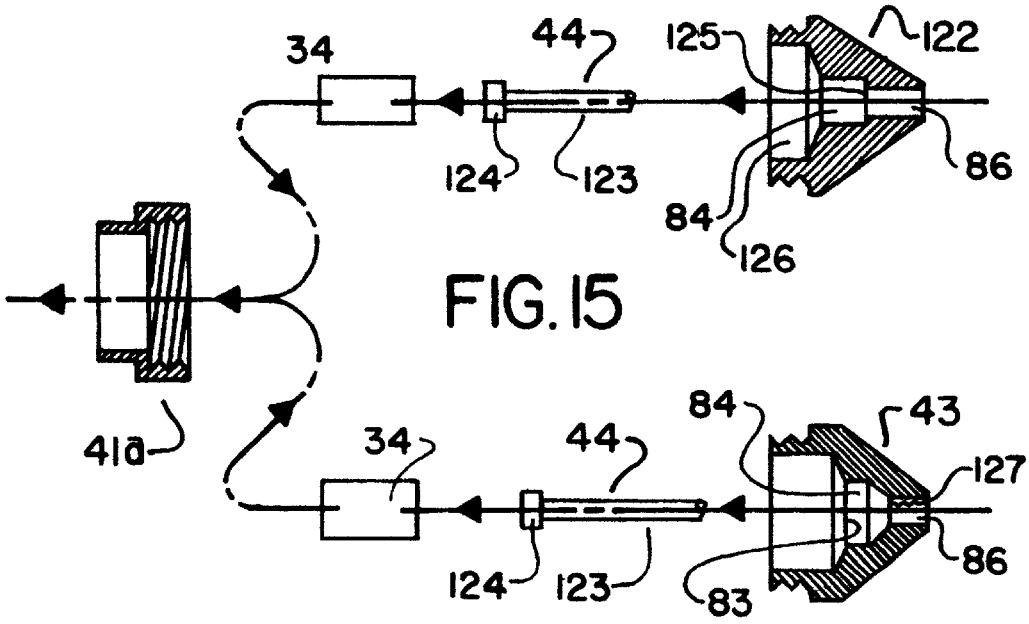
FIG. 15 shows an exploded cross section of two possible assemblies of an aft cap, flight shaft, and elastomeric cylinder.
Figure 16:
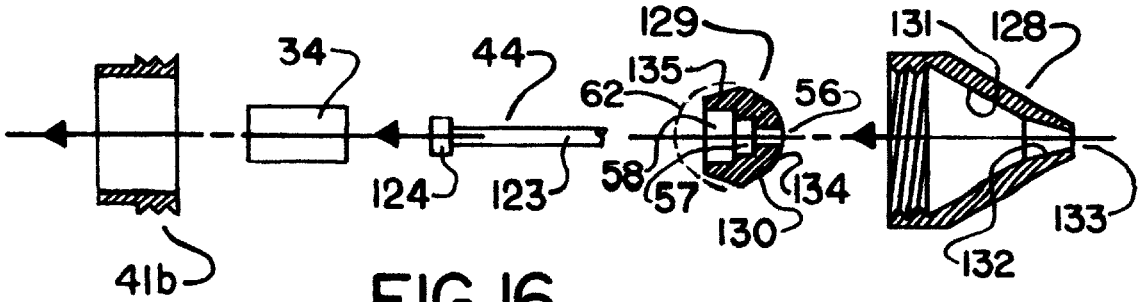
FIG. 16 shows an exploded cross section of an end cap, shaft carrier, flight shaft, and elastomeric cylinder.

FIGS. 14–16 show various arrangements for attaching the flight carrier to the aft end of the dart. FIG. 14 shows an aft cap 120, which threadably receives, at its aft end, a flight shaft 17. The fore end of the cap has a threaded bore to receive thread bearer 41*b*. Extending from the forward bore is a cup receiver 121 for cylinder 34.

FIG. 15 shows two alternative end caps engageable with aft thread bearer 41*a* (note FIG. 4). End cap 122 is the same type of end structure shown in FIG. 5, except that this cap is shown integral with the barrel in FIG. 5. End cap 122 includes a forward bore 126, serving as an end chamber for the central body, a cup bore 84 having an end shoulder 125, and a through bore 86. The flight shaft assembly 44 is inserted from the fore end through the end cap, so the shaft 123 slides through bore 86, and end collar 124 rests against shoulder 125. Elastomeric cylinder 34 then seats in bore 126, and applies a biasing force against the shaft assembly 44 (the opposite end of cylinder 34 being received in a cup 58, 102, or 114).

End cap 43 is the same as shown in FIG. 4, and is similar to cap 122, except that the shoulder 125 is replaced by tapered transition 127 between bores 84 and 86, and bore 86 is shorter, this arrangement allowing for a bit of lateral movement against the bias of cylinder 34 upon impact from another incoming dart, as well as longitudinal movement.

FIG. 16 shows an end cap designed to allow more significant pivoting action of the flight shaft assembly 44 upon impact from another dart. The aftcap 128 includes an inner chamber with tapered walls 131, which terminate in a passage 133. A carrier 129 is provided having a forward partial ball 134, and tapered walls 130 which mate with carrier walls 131, as well as pivot-limiting walls 135. The carrier includes a front bore 58, intermediate bore 57, and through bore 56. The shaft 123 is passed through bore 56 until collar 124 seats in bore 57. The carrier is then placed within aftcap 128 so the shaft 123 extends through opening 133. Elastomeric cylinder 34 seats in bore 58 of the carrier, and the cap is threaded onto thread bearer 41*b* of the dart. The cylinder biases the carrier into engagement with the aftcap so shaft 123 extends to the rear of the dart along its longitudinal axis. Upon impact from another dart, the shaft 123 can pivot and move longitudinally against the bias of cylinder 34, to reduce deflection of that other dart.

It is important to note that the attachments of FIGS. 15 and 16 also allow the shaft assembly 44 to rotate about the axis of the dart, to further reduce deflection of an incoming dart.

Figure 17:
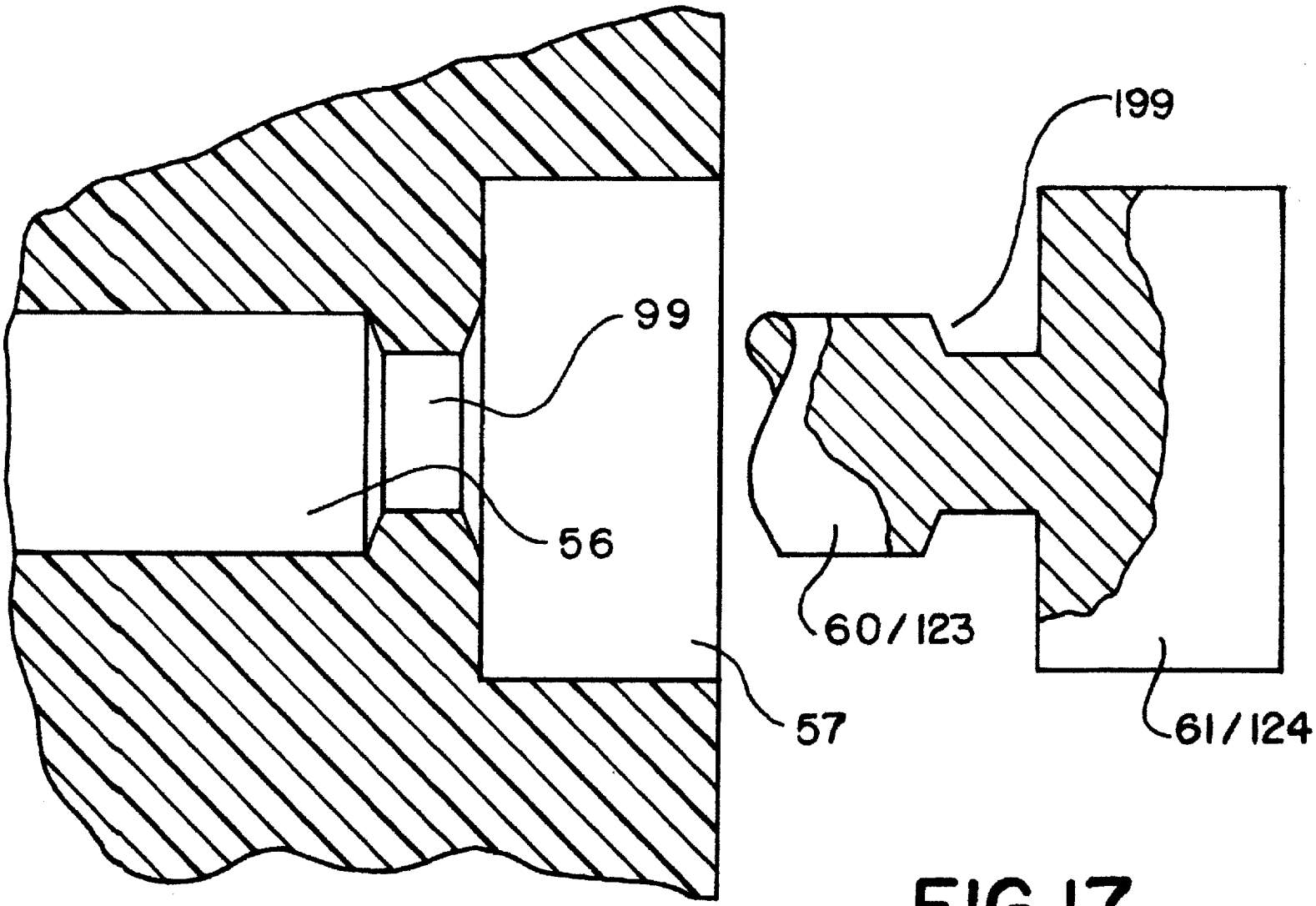
FIG. 17 shows a detail view, partly in section, of an attachment between a collared flight shaft or point shaft, and its associated carrier.

FIG. 17 shows a view of an alternative engagement between a shaft and a carrier. The shaft may be a point shaft 60, with collar 61, which is engaged into a carrier 33 or 45; or may be a flight shaft 123 with collar 124, which is engaged into carrier 129. The shaft includes a radially indented portion 199 having a tapered wall, at the junction with the collar. The carrier includes a reduced diameter portion 99 between collar seat 57 and through bore 56, with tapered transition walls. When the point is pushed into the carrier and the collar is seated in bore 57, the reduced diameter portion will engage the indentation 199 to resist longitudinal separation therebetween, while allowing relative rotation between the point and carrier. This will help prevent loss of these small parts during dart disassembly.

It is important to note that the various embodiments of dart parts disclosed can be combined in a "mix and match" fashion to create a completed dart; only a few of the possible combinations have been illustrated herein. It is contemplated that parts will be sold in a kit form, which dart players will assemble according to their needs and skill level. This will provide a player with the ability to build highly customizable darts which have a reduced tendency for target rejection, and reduced deflection of subsequently thrown darts. This is considered an advantage not possible with prior art dart constructions. Accordingly, the invention is not limited by the illustrations and examples in the specification, but only by the following claims.

What is claimed is:

1. A dart, comprising:

a body having a hollow interior, with a forward opening forming a socket, and a flight shaft at a rear end;

a point having a point shaft with a forward end to be received in a target, the point shaft having an enlarged point shaft collar at a rearward end;

a carrier for the point shaft, the carrier having a central bore to receive the point shaft, and a seat at a rearward end to receive the point shaft collar, the carrier adapted to be biased toward the socket, without passing therethrough, with the point shaft projecting forward therefrom, the carrier further having a cylinder-receiving bore at a rearward end;

an elastomeric cylinder having a first end received in the cylinder-receiving bore, for biasing the carrier and point shaft forward;

a cup receiver located within the dart body, rearward of the carrier, for receiving the second end of the elastomeric cylinder.

2. The dart as in claim 1, in which the carrier has a forward surface which mates with the socket to allow pivotal movement of the carrier in response to lateral forces on the dart body or point, so the point can assume positions which are not parallel to a central axis of the dart body.

3. The dart as in claim 1, in which a guide (64) is provided which non-pivotally mates with the socket, the guide having a forward bore (65) to receive the point shaft, and a rearwardly open cavity (66);

the carrier (69) comprising a surface (70) which slidably mates with the cavity (66).

4. A dart, comprising:

a body having a hollow interior, with a point shaft projecting from a front end, and a flight shaft projecting from a rear end;

an adjustable weight system located within the hollow body, between the point shaft and flight shaft, said adjustable weight system adapted for adjusting the relative weight ratio between the forward and rearward ends of the dart body;

said adjustable weight system including a forward end and a rearward end;

at least one of the forward end or rearward end of the adjustable weight system including a cup receiver adapted to receive one end of an elastomeric cylinder, said elastomeric cylinder adapted to apply bias against at least one of the point shaft or flight shaft.

5. The dart as in claim 4, in which the weight system includes a fully threaded rod having pintle ends, at least one weight bead having a central bore to be slidably received over the threaded rod;

a position nut (90), and a stop nut (98), each with a threaded central bore, threadedly received on the rod, and adapted to be tightened against the at least one weight bead to hold it in a desired position along the rod;

a forward threaded insert (39) threadably held within the dart body, the forward threaded insert including a rearwardly open bore (77) to rotatably receive a pintle end of the rod, and a forwardly open cup receiver (73);

a rearward cup (101) having an end wall (103) that abuts the other pintle end of the rod, the rearward cup having a rearwardly open cup receiver (102).

6. The dart as in claim 4, in which the weight system includes a shaft (104) having a shoulder (105) at a first end, and a threaded segment at a second end; a plurality of beads (106, 107) with various weights received along the shaft; an end nut (136) received over the first end, having a sink (57) for receiving the shoulder; and a stop nut (98) threaded onto the second end;

in which the end nut includes a cup receiver (58).

7. The dart as in claim 4, in which the weight system includes a solid billet of material, with a cutout race (108) to adjust the weight distribution therealong, and in which at least one end of the billet has a cup receiver (58) formed thereinto.

8. The dart as in claim 4, in which the weight system includes a solid billet of material, with a bore (110, 113) of substantial length extending into one end thereof;

powdered weight material (51) packed partially into the bore, leaving a gap at the outer end of the bore;

a cup receiver formed in the gap.

9. The dart as in claim 4, in which the weight system includes a hollow housing (115); two layers of powdered weight material (51) packed thereinto, the two layers of weight material being separated by a relatively lightweight layer of elastomeric material (117);

a closure body (119) mounted in one end of the housing to retain the weight material and elastomeric material, the closure body having a cup receiver (58) formed therein.

10. A dart comprising:

a body having a hollow interior, with a point shaft projecting from a front end, the body having an opening at its rearward end, for receiving a flight shaft;

the flight shaft having an enlarged flight shaft collar at its forward end, and means to receive a dart flight at its rearward end;

an elastomeric cylinder mounted in the dart body, and having a first end in contact with the flight shaft collar, for biasing the flight shaft rearward;

a cup receiver located within the dart body, forward of the flight shaft, for receiving a second end of the elastomeric cylinder.

11. The dart of claim 10, in which the body includes a cup bore (84) for receiving the elastomeric cylinder, forward of the opening for the flight shaft, the cup bore having a rear shoulder (125) to seat the flight shaft collar.

12. The dart of claim 10, in which the rear of the body includes tapered walls (131) leading to the opening for the flight shaft;

a carrier (129) having a central bore (56) to receive the flight shaft, a rearward seat (57) for the flight shaft collar, and a rearward bore (58) to receive the elastomeric cylinder;

the carrier having a rearward surface which mates with the tapered walls to allow pivotal movement of the carrier in response to lateral forces on the dart body or flight shaft, so the flight shaft can assume positions which are not parallel to a central axis of the dart body.

* * * * *